US005955411A

United States Patent [19]

Gorlin

[11] Patent Number: 5,955,411

[45] Date of Patent: Sep. 21, 1999

[54] HIGH FOAMING NONIONIC SURFACTANT BASED LIQUID DETERGENT

[75] Inventor: Philip Gorlin, Monmouth Junction, N.J.

[73] Assignee: Colgate Palmolive Company, New York, N.Y.

[21] Appl. No.: 09/089,189

[22] Filed: Jun. 2, 1998

[51] Int. Cl.[6] ..... C11D 1/12; C11D 1/75; C11D 3/48

[52] U.S. Cl. ..... 510/237; 510/235; 510/428; 510/470; 510/503

[58] Field of Search ..... 510/426, 235, 510/237, 405, 414, 424, 428, 499, 503, 470, 427, 417

[56] References Cited

U.S. PATENT DOCUMENTS 5,700,773 12/1997 Jakubicki et al. ..... 510/426
5,767,051 6/1998 Drapier et al. ..... 510/235
5,853,743 12/1998 Gambogi et al. ..... 424/405
5,854,195 12/1998 Jakubicki et al. ..... 510/426
5,856,292 1/1999 Thomas et al. ..... 510/426
5,856,293 1/1999 Gambogi et al. ..... 510/426
5,869,439 2/1999 Thomas et al. ..... 510/235

*Primary Examiner*—Yogendra Gupta
*Assistant Examiner*—Gregory E. Webb
*Attorney, Agent, or Firm*—Richard E. Nanfeldt

[57] ABSTRACT

A light duty, liquid comprising: a magnesium linear alkyl benzene sulfonate, a sodium ethoxylated alkyl ether sulfate, an ammonium ethoxylated alkyl ether sulfate, an alpha olefin sulfonate, a poly alkyl glucoside, polyethylene glycol and water.

10 Claims, No Drawings

HIGH FOAMING NONIONIC SURFACTANT BASED LIQUID DETERGENT

BACKGROUND OF THE INVENTION

The present invention relates to novel light duty liquid detergent compositions with high foaming properties and having antibacterial properties.

The prior art is replete with light duty liquid detergent compositions containing nonionic surfactants in combination with anionic and/or betaine surfactants wherein the nonionic detergent is not the major active surfactant. In U.S. Pat. No. 3,658,985 an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8 to 20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition containing an alkali metal silicate, urea, glycerin, triethanolamine, an anionic detergent and a nonionic detergent. The silicate content determines the amount of anionic and/or nonionic detergent in the liquid cleaning composition. However, the foaming properties of these detergent compositions are not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to affect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contain an active ingredient mixture wherein the nonionic detergent is present in major proportion which is probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

SUMMARY OF THE INVENTION

It has now been found that a high foaming liquid detergent having antibacterial properties can be formulated with an alkyl benzene sulfonate, an alpha olefin sulfonate, two different ethoxylated alkyl ether sulfates, an amine oxide, an alkyl polyglucoside, polyethylene glycol and an antibacterial agent which is soluble in the polyethylene glycol.

Accordingly, one object of this invention is to provide novel, high foaming, light duty liquid detergent compositions containing polyethylene glycol in order to improve the viscosity of the composition and to improve the flash foam point of the composition.

Another object of this invention is to provide novel, liquid detergent compositions containing both polyethylene glycol and an antibacterial agent.

To achieve the foregoing and other objects and in accordance with the purpose of the present invention, as embodied and broadly described herein the novel, high foaming, light duty liquid detergent of this invention comprises a magnesium salt of an alkyl benzene sulfonate, an alpha olefin sulfonate, an ammonium salt of an ethoxylated alkyl ether sulfate, a sodium salt of an ethoxylated alkyl ether sulfate, an alkyl polyglucoside, an amine oxide, a polyethylene glycol, optionally, an antibacterial agent and water wherein the composition does not contain a glycol ether solvent, an ethoxylated and/or propoxylated nonionic surfactant, a zwitterionic surfactant, a polyoxyalkylene glycol fatty acid, a builder, a polymeric thickener, an acid, a clay, a fatty acid alkanol amide, abrasive, silicas, triloscan, alkaline earth metal carbonates, alkyl glycine surfactant, cyclic imidinium surfactant, or more than 0.2 wt. % of a perfume or water insoluble hydrocarbon other than trichlorocarbanilide.

DETAILED DESCRIPTION OF THE INVENTION

The present invention relates to a light duty liquid detergent which comprises approximately by weight:

(a) 2% to 8% of an ammonium salt of an ethoxylated alkyl ether sulfate surfactant;

(b) 7% to 18% of an alpha olefin sulfonate surfactant;

(c) 0 to 5% of an amine oxide surfactant;

(d) 5% to 12% of an alkyl polyglucoside surfactant;

(e) 2% to 8% of a sodium salt ethoxylated alkyl ether sulfate surfactant;

(f) 0.5% to 4% of a polyethylene glycol having a molecular weight of 15.0 to 1000;

(g) 0 to 1%, more preferably 0.05 wt. % to 0.75 wt. % of an antibacterial agent which is trichlorocarbanilide;

(h) 5% to 10% of a magnesium salt of a $C_9$–$C_{18}$ alkyl benzene sulfonate; and (i) the balance being water wherein the composition does not contain a glycol ether solvent, a nonionic surfactant, a zwitterionic surfactant, a polyoxyalkylene glycol fatty acid, a builder, a polymeric thickener, an acid, a clay, a fatty acid alkanol amide, abrasive, silicas, triloscan, alkaline earth metal carbonates, alkyl glycine surfactant, cyclic imidinium surfactant, or more than 0.2 wt. % of a perfume or water insoluble hydrocarbon other than trichlorocarbanilide.

The present invention also relates to a concentrated composition which comprises approximately by weight:

(a) 5% to 25%, more preferably 10% to 20% of trichlorocarbanilide; and (b) 75% to 95%, more preferably 80% to 90% of a polyethylene glycol having a molecular weight of about 100 to about 5,000, wherein the concentrated composition contains less than 0.5 wt. % of water.

The concentrated composition of the polyethylene glycol and trichlorocarbanilide is added to the surfactant mixture in the light duty liquid composition to form a light duty liquid composition having antibacterial properties. If the trichlorocarbanilide is added directly to the surfactant mixture in the light duty liquid composition without dissolving the trichlorocarbanilide in the polyethylene glycol, the trichlorocarbanilide is insoluble in the light duty liquid composition. In forming the concentrated composition of the trichlorocarbanilide and polyethylene glycol it is important to minimize water which can hydrolyze the trichlorocarbanilide. Accordingly, the polyethylene glycol is heated to at least about 105° C. and then cooled to about 90° C. at which point the trichlorocarbanilide is mixed with stirring into the heated polyethylene glycol. The concentrated composition of the polyethylene glycol and trichlorocarbanilide is added with stirring to the preformed surfactant mixture of the light duty liquid composition.

The instant composition contains 5 wt. % to 10 wt. %, more preferably 6 wt. % to 9 wt. % of a magnesium salt of a $C_9$–$C_{18}$, more preferably $C_{10}$–$C_{16}$ alkyl benzene sulfonate. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 atoms.

The instant compositions contain a mixture of two ethoxylated alkyl ether sulfate surfactant. A sodium salt of a $C_8$–$C_{18}$ ethoxylated ether sulfate having one to five ethylene oxide groups is present in the composition at a concentration of about 2 wt. % to about 8 wt. %, more preferably about 3 wt. % to about 7 wt. %. An ammonium salt of a $C_8$–$C_{18}$ ethoxylated alkyl ether sulfate having one to five ethylene oxide groups is present in the composition at a concentration of about 2 wt. % to about 8 wt. %, more preferably about 3 wt. % to 7 wt. %.

The ethoxylated alkyl ether sulfates are obtained by sulfating the condensation product of ethylene oxide with a $C_8$–$C_{18}$ alkanol and neutralizing the resultant product. The ethoxylated alkyl ether sulfates differ from one another in the number of moles of ethylene oxide reacted with one mole of alkanol. Preferred ethoxylated alkyl ether sulfates contain 10 to 16 carbon atoms in the alkyl group.

The present invention also contains 7 wt. % to 18 wt. %, more preferably 8 wt. % to 15 wt. % of an alpha olefin sulfonates, including long-chain alkene sulfonates, long-chain hydroxyalkane sulfonates or mixtures of alkene sulfonates and hydroxyalkane sulfonates. These alpha olefin sulfonate surfactants may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred alpha olefin sulfonates contain from 14 to 16 carbon atoms in the R alkyl group and are obtained by sulfonating an a-olefin.

The amine oxides used at a concentration of 0 to 5 wt. %, more preferably 0.5 wt. % to 4 wt. % in forming the light duty liquid compositions are depicted by the formula:

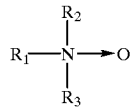

wherein $R_1$ is a $C_{10}$–$C_{18}$ an linear or branched chain alkyl group, $R_2$ is a $C_1$–$C_{16}$ linear alkyl group and $R_3$ is a $C_1$–$C_{16}$ linear alkyl group, or the amido radical:

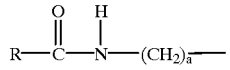

wherein R is an alkyl group having about 9 to 19 carbon atoms and a is the integer 1 to 4: $R_2$ and $R_3$ are each alkyl groups having 1 to 3 carbons and preferably 1 carbon;

The instant compositions can contain about 0.1 to about 4 wt. %, more preferably 0.2 to 3.0 wt. % of an alkyl polysaccharide surfactant. The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=18 (0.5%) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The polyethylene glycol used in the instant compositions at a concentration of 0.5 wt. % to 4 wt. %, more preferably 1 wt. % to 3 wt. % are depicted by the formula:

$$HO\text{-}(CH_2—CH_2O)_nH$$

wherein n is about 4 to about 110, more preferably about 10 to about 100, wherein PEG600 or PEG200 are preferred which are a polyethylene glycol having molecular weight of about 600 and 200 respectively.

The water is present at a concentration of 40 wt. % to 83 wt. %.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pH modifiers; etc. The proportion of such adjuvant materials, in total will normally not exceed 15% by weight of the detergent composition, and the percentages of most of such individual components will be a maximum of 5% by weight and preferably less than 2% by weight. Sodium formate or formalin can be included in the formula as a perservative at a concentration of 0.1 to 4.0 wt. %. Sodium bisulfite can be used as a color stabilizer at a concentration of 0.01 to 0.2 wt. %.

The present light duty liquid detergents such as dishwashing liquids are readily made by simple mixing methods from readily available components which, on storage, do not adversely affect the entire composition. Solubilizing agent such as ethanol, sodium chloride and/or sodium xylene or sodium xylene sulfonate are used to assist in solubilizing the surfactants, an aqueous solution of the nonionic based surfactant system. The use of mild heating (up to 100° C.) assists in the solubilization of the surfactants. The viscosities are adjustable by changing the total percentage of active ingredients. In all such cases the product made will be pourable from a relatively narrow mouth bottle (1.5 cm. diameter) or opening, and the viscosity of the detergent formulation will not be so low as to be like water. The viscosity of the light duty liquid composition desirably will be at least 100 centipoises (cps) at room temperature, but may be up to 1,000 centipoises as measured with a Brookfield Viscometer using a number 3 spindle rotating at 12 rpm. The viscosity of the light duty liquid composition may approximate those of commercially acceptable light duty liquid compositions now on the market. The viscosity of the light duty liquid composition and the light duty liquid composition itself remain stable on storage for lengthy periods of time, without color changes or settling out of any insoluble materials. The pH of the composition is substantially neutral to skin, e.g., 4.5 to 8 and preferably 5.0 to 7.0. The pH of the composition can be adjusted by the addition of $Na_2O$ (caustic soda) to the composition.

These products have unexpectedly desirably properties. For example, the foam quality and detersive property are equal to or better than standard light duty liquid detergents by employing the polyethylene glycol in the composition one obtains lower viscosities while using reduce amounts of solubilizing agents and reduce flash foam points are achieved.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by weight.

Description of the Preferred Embodiments

EXAMPLE 1

The following formulas were prepared at room temperature by simple liquid mixing procedures as previously described

| | A | B | C | D | E |
|---|---|---|---|---|---|
| Sodium olefin sulfonate | 10 | 10 | 10 | 14 | 14 |
| Ammonium ethoxylated alkyl ether sulfate 3EO | 5 | 5 | 5 | 4.45 | |
| Sodium etho.1EOxylated alkyl ether sulfate | 5 | 5 | 5 | 4.45 | 4.45 |
| Cocoamido propyl amine oxide | 4 | 2 | | 2 | 2 |
| APG625 | 8 | 8 | 8 | 8 | 8 |
| Mg alkyl benzene sulfonate | 6.3 | 6.3 | 6.3 | 7.1 | 7.1 |
| PEG600 | | 2 | 4 | 2 | 2 |
| Trichloro carbanilide | | | | 0.2 | |
| Ethanol | 3 | 3 | 3 | 4.25 | 4.25 |
| Sodium chloride | 1 | 1 | 1 | 1.5 | 1.5 |
| Sodium xylene sulfonate | 0.5 | 0.5 | 0.5 | 0.5 | 0.5 |
| Water | Bal. | Bal. | Bal. | Bal. | Bal. |
| Shake form (ml) | 372 | 380 | 387 | | |
| Viscosity (cp) RT, #21 spindle, 25 rpm | 2245 | 875 | 380 | | |
| Minimum inhibitory concentration test concentration of formula need to kill *Staph aureus*[1] | | | | 0.1% | 0.01% |

What is claimed is:

1. A light duty liquid detergent composition comprising approximately by weight:

(a) 5% to 10% of a magnesium linear alkyl benzene sulfonate;

(b) 24% to 8% of a sodium ethoxylated alkyl ether sulfate;

(c) 2% to 8% of an ammonium ethoxylated alkyl ether sulfate;

(d) 7% to 18% of an alpha olefin sulfonate;

(e) 0 to 5% of an amine oxide;

(f) 0.05 wt. % to 0.75 wt. % of trichloro carbanilide;

(g) 5% to 12% of an alkyl polyglucoside; and (h) the balance being water.

2. A light duty liquid composition according to claim 1 which includes, in addition, 1% to 15% by weight of a solubilizing agent which is ethanol, sodium chloride and/or a water soluble salts of $C_1$–$C_3$ substituted benzene sulfonate hydrotropes and mixtures thereof.

3. A light duty liquid composition according to claim 1 further including a color stabilizer.

4. A light duty liquid composition according to claim 1 wherein the concentration of the amine oxide is 0.5 wt. % to 4 wt. %.

5. A light duty liquid detergent composition comprising approximately by weight:

(a) 5% to 10% of a magnesium linear alkyl benzene sulfonate;

(b) 24% to 8% of a sodium ethoxylated alkyl ether sulfate;

(c) 2% to 8% of an ammonium ethoxylated alkyl ether sulfate;

(d) 7% to 18% of an alpha olefin sulfonate;

(e) 0 to 5% of an amine oxide;

(f) 0.5% to 4% of a polyethylene glycol;

(g) 5% to 12% of an alkyl polyglucoside; and (h) the balance being water, wherein the composition does not contain a zwitterionic surfactant or a fatty acid alkanol amide.

6. A light duty liquid composition according to claim 5 which includes, in addition, 1% to 15% by weight of a solubilizing agent which is ethanol, sodium chloride and/or a water soluble salts of $C_1$–$C_3$ substituted benzene sulfonate hydrotropes and mixtures thereof.

7. A light duty liquid composition according to claim 5 further including 0.05 wt. % to 0.75 wt. % of trichloro carbanilide.

8. A light duty liquid composition according to claim 5 further including a perservative.

9. A light duty liquid composition according to claim 5 further including a color stabilizer.

10. A light duty liquid composition according to claim 5 wherein the concentration of the amide oxide is 0.5 wt. % to 4 wt. %.

* * * * *